United States Patent [19]

Ranft

[11] Patent Number: 4,730,630

[45] Date of Patent: Mar. 15, 1988

[54] DISHWASHER WITH POWER FILTERED RINSE

[75] Inventor: Paul H. Ranft, Columbus, Ohio

[73] Assignee: White Consolidated Industries, Inc., Cleveland, Ohio

[21] Appl. No.: 923,413

[22] Filed: Oct. 27, 1986

[51] Int. Cl.[4] ..... B08B 3/04

[52] U.S. Cl. ..... 134/111; 134/56 D; 134/109; 210/409; 210/416.1

[58] Field of Search ..... 134/111, 110, 109, 56 D, 134/57 D, 58 D; 210/421, 422, 416.1, 409, 428

[56] References Cited

U.S. PATENT DOCUMENTS 2,824,648 2/1958 Bear ..... 210/422

3,332,259 7/1967 Zylstra ..... 134/111

3,727,435 4/1973 Menk ..... 134/111

*Primary Examiner*—Renee S. Luebke

*Attorney, Agent, or Firm*—Pearne, Gordon, McCoy & Granger

[57] ABSTRACT

A dishwasher has a washing chamber having at the top a rotatable wash arm which is supplied with filtered fluid from the dishwasher pump to prevent redeposition of soil particles on the dishes. In one embodiment, the fluid is supplied when the unit is in the recirculate or wash mode at all times by bypassing a certain amount of the pump output through an external filter to the third level wash arm. Fluid is also supplied during the drain cycle as a bypass from the drain outlet. In another embodiment, the fluid is supplied only during the drain portion of the cycle.

11 Claims, 7 Drawing Figures

DISHWASHER WITH POWER FILTERED RINSE

BACKGROUND OF THE INVENTION

This invention relates generally to dishwashing machines, and more particularly to soil collectors for dishwashing machines of the domestic or household type.

Dishwashers of this type generally consist of an enclosed cabinet having a bottom hinged door at the front closing off an otherwise sealed tube having a sump formed at the bottom portion thereof. The dishes are generally placed on upper and lower racks which are arranged to slide or roll in and out of the dishwasher when the door is open for loading and unloading the articles to be washed. Generally, these racks are arranged so that plates, pots and pans and other large articles are placed on the lower rack while smaller articles like cups and glasses are placed on the upper rack which is located close to the top of the compartment. The dishwashers all generally have a rotating lower wash arm which rotates as a reaction to jets of liquid and carries a number of spray openings directing the water upward as the arm rotates to spray all of the dishes in the interior. Certain of the machines also have the second level wash arm located above the lower rack and below the upper rack to provide additional washing ability. Furthermore, many dishwashers also have a third level wash arm located centrally beneath the top wall of the cabinet to spray fluid down on all of the dishes in both the upper and lower racks.

The dishwashing cycle consists of alternate cycles of washing and rinsing in which the washing cycle is distinguished generally only by the length of time and the fact that a detergent has been added to the wash water. During the cycle, the water is drawn from the sump at the bottom and passes through a pump to the wash arms from which, after passing over the dishes in the racks, it returns to the bottom sump. Between the cycles, it is necessary to provide a drain for the fluid within the machine so that it can receive a refill of fresh water.

Generally, the pumping action of dishwashers falls into two categories. In one of these, there are separate pumps for wash circulation and drain which may be driven by the same motor, and in which the pumps are arranged so that each pump is effective only in one direction of rotation of the motor. Thus, when it is desired to recirculate wash water, the pump rotates in one direction, and when it is desired to drain the water from the interior, the motor rotates in the opposite direction to actuate the drain pump. The other type of machine uses a single pump with a unidirectional, nonreversible motor. Thus, at all times the water is drawn from the inlet at the bottom of the sump and passes through the pump to an outlet area. In this area is a diverter valve, which may be solenoid-actuated, and which serves to direct fluid either to the wash arms and the interior of the tub or to drain. By having the drain outlet closer to the pump impeller, the diverter valve is operable in one position to close off the drain line and direct all of the fluid further downstream, where it may pass through separate conduits to second and third level wash arms, while the major portion of the flow goes to the lower wash arm. When the diverter valve is actuated by a solenoid, the valve swings to close off the downstream portion so that all of the fluid passes out the drain line. With such an arrangement, the pressure of the flow against the valve would hold it in the closed position even if the solenoid is de-energized, so that the valve could not return to the wash position until all of the fluid had effectively been drained from the machine. Such an arrangement may be found in U.S. Pat. No. 3,367,368, granted Feb. 6, 1968.

A problem encountered by dishwashers of all types is that of handling the soil removed from the dishes and other items being washed in the dishwasher. Such soil, as it is washed off the dishes, passes into the water in the sump, and thus is drawn into the pump inlet and recirculated through the wash arms during a wash or rinse cycle, and is therefore subject to being redeposited on the dishes from which it had originally been removed. If the soil particles are particularly large, they will be blocked by an inlet screen in the sump from passing into the pump, and can be removed manually after the washing cycle has been completed. However, removal of soil of this type is only a small portion of the problem, since the screen must be relatively coarse so as not to become clogged by excessive particles and the likelihood that the screen will not be cleaned by hand after every wash cycle. Thus, it must be expected that most of the soil removed from the dishes will necessarily tend to be recirculated through the pump and wash arms and subject to possible redeposit on the dishes being washed.

In the case of dishwashers having separate drain and recirculation pumps, the solution to this problem has been to provide a form of collector or filter arranged in such a manner that when the machine is in a recirculating cycle such as washing or rinsing, the fluid, or at least part of it, will pass through a screen or filter, and thereby be removed from the recirculating cycle. Such a filter or screen must necessarily be cleaned often, and various arrangements have been proposed whereby the screen is automatically cleaned by water going to the drain from the drain pump during the drain cycle so that the soil particles caught on the screen or filter pass directly to drain and the screen or filter is cleaned for the next portion of the wash cycle.

Such an arrangement has heretofore not been possible in dishwashers using a single unidirectional pump. Therefore, machines of this type generally are provided with a macerator or cutting blade at the pump inlet which may be attached to the pump impeller so as to cut or break up soil particles as they are continuously recirculated through the pump until they become sufficiently fine as to become suspended in the recirculating fluid and less likely to be redeposited on the dishes. Thus, by using a succession of several wash cycles with interposed rinse cycles, soil will be eventually discharged to drain under the drain cycle so that the final rinse cycle will consist of essentially pure water with a minimum of soil particles.

SUMMARY OF THE INVENTION

The present invention provides a self-cleaning soil collector which functions to supply filtered water to an upper level arm so that the filtered water will wash or rinse any soil particles off the items in the dishwasher even if such soil has been redeposited on the dishes by the action of the main wash arm.

According to the preferred embodiment of the invention, the dishwasher has a single pump having a main outlet connected to the main or lower wash arm and a drain outlet connected to the household drain. The pump also has a secondary outlet for connection to a third level wash arm mounted on the top surface of the tub. A diverter valve in the pump ensures that the discharge of the pump is directed either to the main and upper level outlets while the drain outlet is sealed off during the wash and rinse cycles of the dishwasher or, during the drain cycle, solely to the drain outlet. The filter comprises a housing having a filter screen dividing the filter into a pair of chambers. One of the chambers is connected to the third level wash arm, while the second chamber is connected to both the drain outlet and the secondary outlet of the pump. This chamber also has a drain outlet connected to the household sewage system.

Preferably, the drain outlet of the filter and the inlet connected to the secondary pump outlet are in axial alignment and function to control the operation of a rocking valve mounted in the second filter chamber. This valve takes two positions, depending upon whether the pump diverter valve is in the wash and rinse or in the drain positions. In the wash and rinse position, the valve moves to one position under the force of the water entering the filter from the pump's secondary outlet to block off the drain outlet as well as to block off the inlet from the pump drain line. This ensures that the water entering the filter housing must pass through the filter screen and up to the third level wash arm. When the pump diverter valve is in the drain position, the water from the drain outlet of the pump enters the drain housing and moves the rocking valve to a second position where the drain outlet is open and the inlet from the secondary pump outlet is closed. In this position, the high flow of drain water washes any accumulated soil particles off the screen and out the drain while providing a continued flow through the filter and to the third level wash arm to ensure that a rinsing action of the dishes is continued using filtered water while the sump of the dishwasher is being drained. Thus, during the drain action, no water flows to the main wash arm beyond a small predetermined flow past the diverter valve to ensure a flushing of the main wash arm and adjacent area of the dishwasher. However, during this drain cycle, filtered rinse water is supplied to the third level wash arm to wash off any redeposited soil, and such water passes back to the sump to be redischarged by the pump through the filter.

According to another important embodiment of the invention, which may be used on lower cost dishwashers, the pump is not provided with a secondary outlet, so that when the diverter valve is in the wash position, all of the pump outlet flow goes directly to the main wash arm. The filter also has two chambers, one of which is connected to a third level wash arm. The other chamber of the filter has an outlet to the household sewage system and an inlet connected to the pump drain outlet. With this type filter, there is no flow to the third level wash arm during the wash cycle, but when the machine goes to a drain cycle, where the diverter valve opens up the drain outlet, most of the pump discharge goes into the drain outlet, and hence into the second chamber of the filter. While much of the water passes directly out of the filter through the drain outlet, the high pressure of the incoming drain flow causes a portion of the water to flow through the filter into the first chamber, and hence to the third level spray arm. With this arrangement, there are no moving parts within the filter, and the filtered water flows to the third level arm only during drain conditions to ensure a continued rinsing of the dishes using filtered water.

DETAILED DESCRIPTION OF THE PREFERRED EMBODIMENTS

Figure 1:
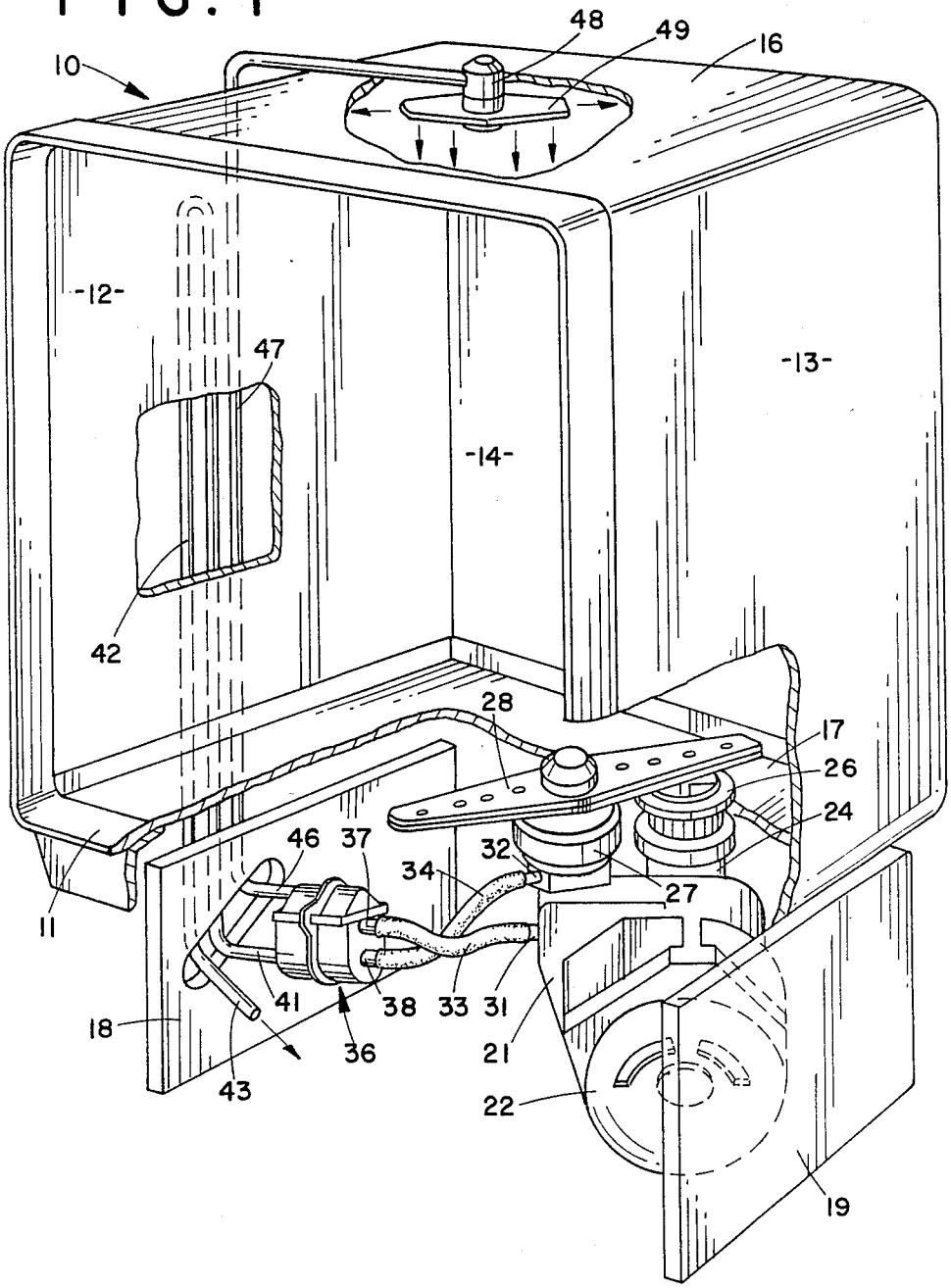
FIG. 1 is perspective view, with parts broken away, of a dishwashing machine incorporating the preferred embodiment of the present invention.

Referring now to the drawings in greater detail, FIG. 1 shows portions of a dishwasher relevant to an understanding of the construction and mode of operation of the present invention. The dishwasher has a tub 10 having an open front 11 normally closed off by a door (not shown) hinged along the lower side and latched at the top. The tub 10 includes a pair of side walls 12 and 13 connected by a back wall 14. A top wall 16 closes off the upper side of the tub, while the bottom is formed into a sump 17, which is generally depressed from a planar surface to accommodate the desired volume of wash water without having it flow out through the open front 11. The dishwasher is supported on a pair of base legs 18 and 19 connected in a suitable manner to the tub 10, and which serve to space the tub above the floor to provide sufficient space for the operating mechanism of the dishwasher.

Below the sump 17 is mounted a pump 21 driven by an integrally mounted electric motor 22. The pump 21 is generally of the centrifugal type, and has an inlet 24 connected to the center of the pump 21 and to an inlet fitting 26 located toward the rear at the lowest portion of the sump 17. The pump has a main outlet 27 connected to a main spray arm 28 which has suitable openings for directing a spray of water at the contents of the tub 16 and, by a reaction force, for causing the spray arm 28 to rotate as it sprays. Also located on the pump 21 is a drain outlet 31 and, above that, a secondary outlet 32. Although the pump is not shown or described in detail, it should be understood that the pump may be constructed generally as shown in U.S. Pat. No. 3,367,368. In that patent, there is shown a solenoid-operated diverter valve (not shown) which, in one position for the wash mode, blocks off the drain outlet 31 and allows the outlet of the pump to be directed to the secondary outlet 32 and to the main spray arm 28. When the diverter valve is actuated by the solenoid to the drain mode position, it substantially blocks off the flow to the secondary outlet 32 and main spray arm 28, so that substantially all of the water flow goes through the drain outlet 31.

The filter unit 36 according to the preferred embodiment of this invention is mounted adjacent the base leg 18 and, on the side facing the pump 21, is provided with a drain inlet 37 on the upper portion which is connected through a drain hose 33 back to the pump drain outlet 31. Likewise, on the lower portion is a secondary inlet 38 connected to the secondary outlet 32 by a suitable hose 34. One the other side of the filter unit 36, on the lower side is a drain outlet 41 connected to a high loop tube 42 to prevent back flow, which in turn, at its other end, has an outlet 43 to be connected to the household sewer drain. On the upper portion of this side of the filter unit 36 is a third level outlet 46 connected through a tube 47 to a hub 48 mounted on the tub top 16, where it is connected to a third level spray arm 49 just beneath the inside surface of the top wall 16. It will be understood that when water is supplied to the third level arm 49 through the tube 47, the arm has suitable outlets to direct water downwardly onto the dishes within the tub 10 and also includes suitable reaction jets which cause the spray arm to rotate to ensure that the spray covers the entire interior of the tub.

Figure 2:
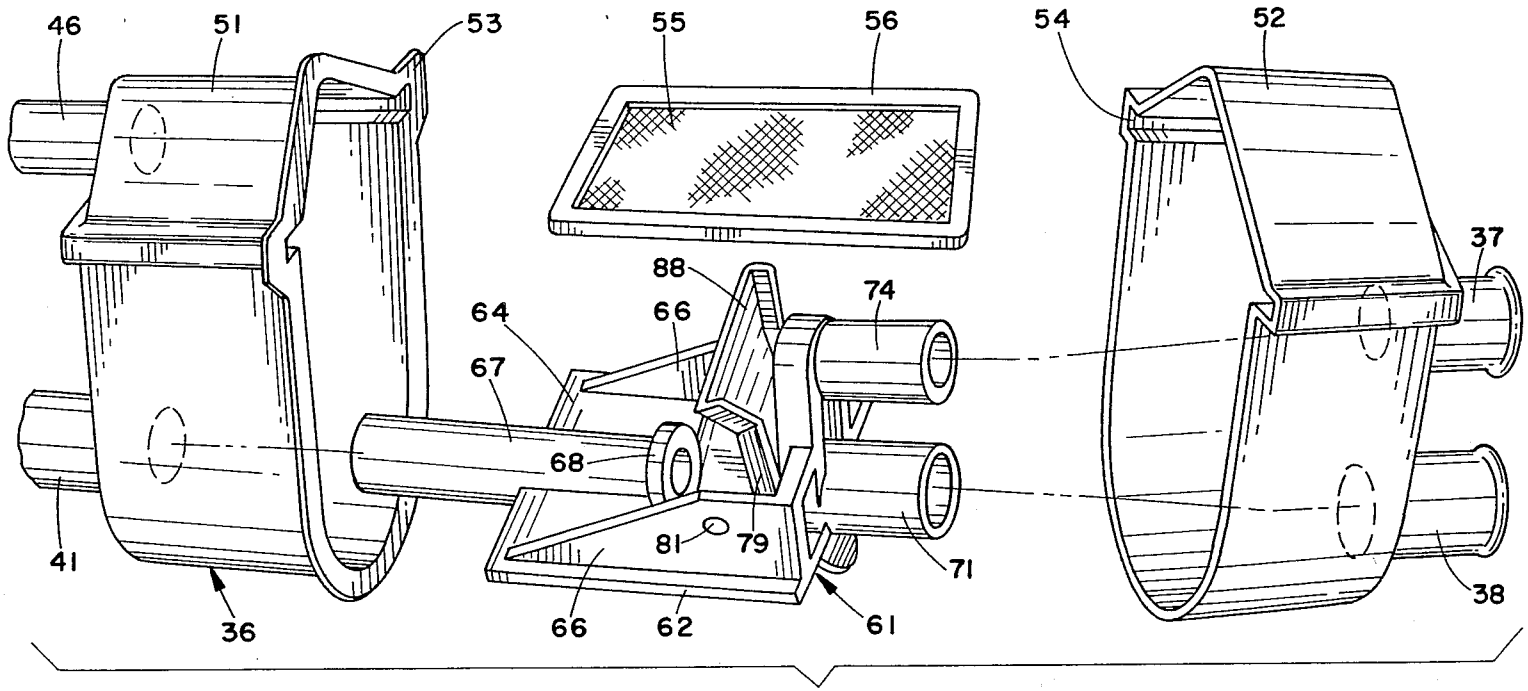
FIG. 2 is an exploded view of the filter unit shown in FIG. 1.
Figure 3:
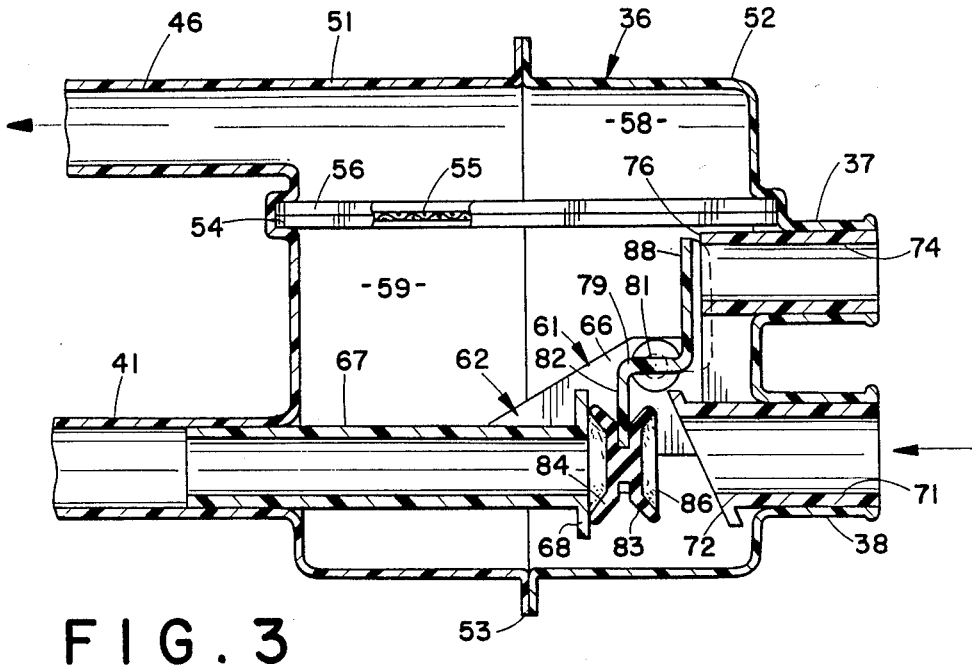
FIG. 3 is a cross-sectional view of the filter of FIG. 2, showing the valve in the wash position.
Figure 4:
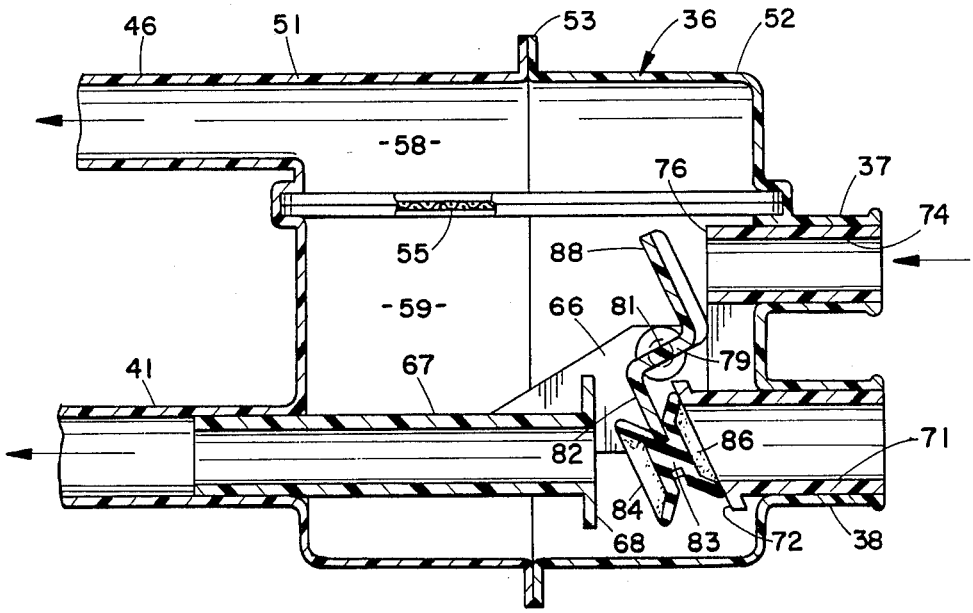
FIG. 4 is an elevational view similar to FIG. 3, but showing the valve in the drain position.

The construction and operation of the filter unit 36 can be understood more easily with reference to FIGS. 2, 3, and 4. The filter unit 36 comprises a housing shell formed in left and right cup-shaped halves 51 and 52. These members 51 and 52 are preferably formed from a thermoplastic material, such as polypropylene, and are secured together around a peripheral flange 53 by a suitable means such as heat sealing or ultrasonic welding. At the upper portion of the two housing members 51 and 52, there is formed an internal groove 54 adapted to receive a screen 55 which is molded into a frame 56 adapted to make sealing engagement with the groove 54. Thus, when the two members 51 and 52 are secured together with the screen 55 in place, the interior of the filter unit 36 will be divided by screen 55 into an upper chamber 58 and a larger, lower chamber 59. It should be noted that on the right half-member 52, both the drain inlet 37 and the secondary inlet 38 open into the lower chamber 59. On the left half-member 51, the drain outlet 41 is connected to the lower chamber 59, while the third level outlet 46 is connected to the upper chamber 58.

The fluid flow through the filter unit 36 is controlled in two different modes, depending upon whether the pump is set for drain or wash, by means of a rocking valve, indicated generally at 61, mounted within the lower chamber 59. The rocking valve 61 includes a one-piece frame 62, preferably formed from a suitable plastic material such as polypropylene. The frame 62 has a generally horizontal center wall 64, at each side of which are a pair of side walls 66 extending upward toward the screen 55. Integral with the horizontal wall 64 is a drain outlet sleeve 67 adapted to make a sliding fit within the housing drain outlet 41, and which carries a sealing flange 68 on the inner face. Also carried on the horizontal wall 64, coaxial with but spaced from the drain outlet sleeve 67, is the secondary inlet sleeve 71, which makes a sealing fit within the secondary inlet 38 and carries a sloping flange 72 on its inner end a spaced distance from the flange 68. Also mounted on the frame 62 is the drain inlet sleeve 74, making a sealing fit within the drain inlet 37 on the filter housing and terminating in an end face 76 directly above the flange 72. It will be understood that the drain outlet sleeve 67 is substantially coaxial with the secondary inlet sleeve 71, and the fit of these sleeves within the housing, together with the drain inlet sleeve 74, positively positions the frame 62 within the filter unit housing without any movement. In the case of the two inlet sleeves 71 and 74, they serve to reinforce the corresponding inlets on the housing half 52 to prevent distortion when the hoses 33 and 34 are held in place by suitable hose clamps (not shown).

The rocking valve member 79 is pivotally mounted between the two side walls 66 by means of a pair of projecting trunnions 81 on opposite sides which fit within suitable bores in the side walls 66. The valve member 79 includes a lower leg 82 which extends down between the flanges 68 and 72, where it carries an elastomeric seal 83. Seal 83 has a left sealing face 84 adapted to make sealing engagement with the flange 68 in one position of the valve, and a right sealing face 86 adapted to make sealing engagement with the flange 72 when the valve member is in the other position. As can be seen from FIGS. 3 and 4, the flange 72 is sloped so that when the valve member 79 has rotated to bring the sealing face 86 in contact with the flange, the flange sealing surface is substantially parallel with the lower leg 82 because of the variations in angular position. On its upper side, the valve member 79 has a deflector surface 88 which extends upward adjacent the drain inlet sleeve end face 76 when the valve makes sealing engagement with the drain oulet flange 68.

Operation of the filter unit 36 can best be seen from FIGS. 3 and 4. When the pump is in the wash mode or recirculate condition, with the majority of the output going to the lower spray arm 28, the secondary wash outlet 32 will also receive some of the pump outlet flow for the third level spray arm. The flow into the filter unit 36 through the secondary inlet 38 will then strike the seal face 86 to rock the valve member 79 in a clockwise direction. This causes the other seal face 84 to make sealing engagement with the drain outlet flange 68 so that no fluid will be lost to the external drain. When the valve member 79 is in this position, the deflector 88 covers the drain inlet end face 76, through it need not make sealing contact therewith because the drain hose 33 is closed off at the pump by the deflector valve. Thus, all of the flow entering through the secondary inlet 38 flows through the lower chamber 59 and, because of the slanted face of flange 72, it tends to be deflected toward the bottom of the chamber, and thereafter flows upward and through the screen 55 into the upper chamber 58, and hence out through the third level outlet 46 to the spray arm 49. At all times during the wash mode, there is a continual flow through the filter unit 36 to the third level spray arm, and since all of the flow must pass through the screen 55, which preferably is of a very fine mesh, this water will have been filtered and contain no soil particles of a size that would be retained on the lower surface of screen 55.

When the pump goes into the drain mode, there is no longer any substantial inlet flow through the secondary inlet 38 but, rather, all of the flow comes through the drain inlet 37. When this occurs, the flow through the drain inlet sleeve 74 causes the water to impinge directly on the deflector 88. This causes the rocking valve member 79 to rotate to the position shown in FIG. 4, in which the right seal face 86 is now in sealing engagement with the secondary inlet sleeve flange 72 to prevent any back flow through the hose 34, and hence to the main spray arm 28. Since the left seal face 84 is now moved away from the drain outlet flange 68, water is able to flow outwardly through the filter drain outlet 41 through the high loop 42 into the household drain. The effect of the deflector 88 is not only to operate the rocking valve member 79, but also, when in the position of FIG. 4, the deflector 88 causes the incoming water to be forced upward against the lower surface of screen 55. This action causes the accumulated soil particles on the underside of the screen to be washed off, and hence outwardly through the drain. Because of the restriction in the downstream portion of the drain, there will be a certain pressure build-up in the lower chamber, even as the cleaning effect takes place, so that there will be a continuing flow through the screen into the upper chamber 58. This flow will continue to the top spray arm 49, so that at all times during the drain mode, there will be a continuing rinsing effect with filtered water from the top level spray arm to wash off any accumulated soil particles that may adhere to the dishes being washed.

It will therefore be seen that the filter unit 36 functions at all times that the pump is driven by the water to supply water filtered by the screen 55 to the top spray arm 49, and this action of the spray arm, directing filtered water onto the dishes, occurs both during the circulating cycles, such as wash and rinse, but also during the drain cycle as long as there is any substantial amount of water being discharged through the pump drain outlet 31. Furthermore, while soil accumulates during the recirculation type of cycle, it is automatically washed off the filter screen 55 at each drain cycle to avoid any possible build-up and clogging of the screen.

Figure 5:
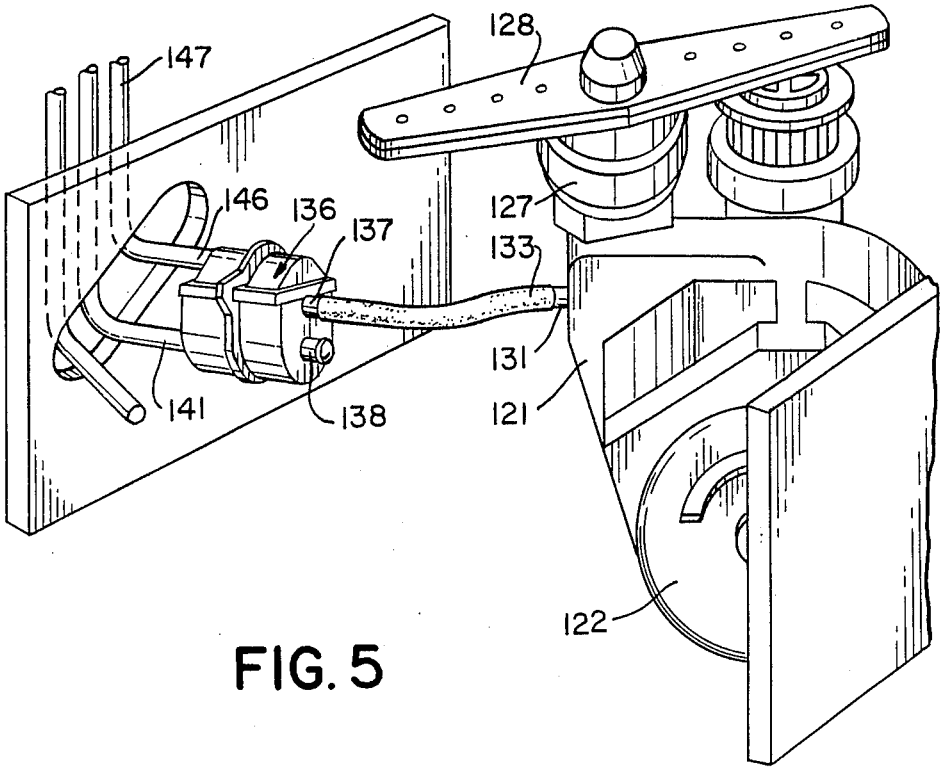
FIG. 5 is a fragmentary, perspective view of a dishwasher incorporating another embodiment of the present invention.
Figure 6:
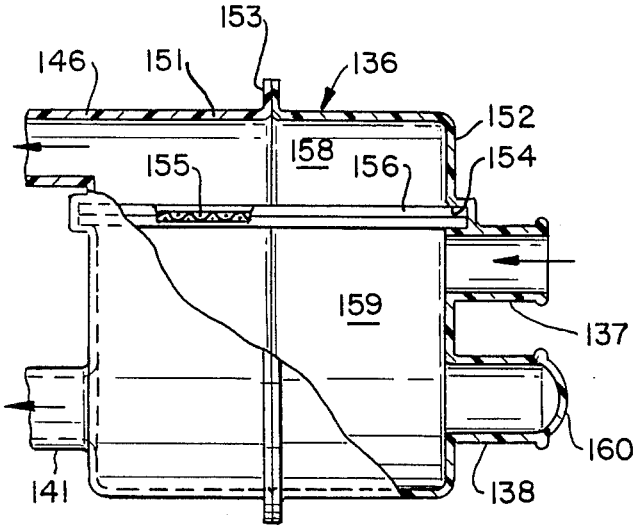
FIG. 6 is an elevational view, with parts broken away, of the filter shown in FIG. 5.
Figure 7:
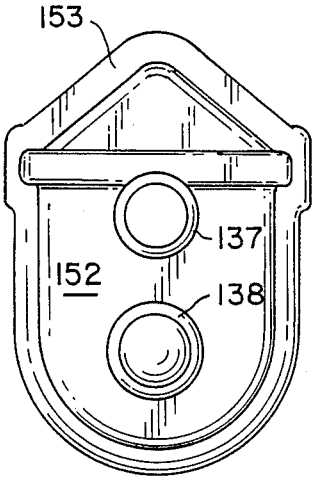
FIG. 7 is an end elevational view of the filter shown in FIGS. 5 and 6.

The invention is also applicable to dishwashing machines of a simpler construction that do not utilize a secondary wash outlet on the pump. Such an embodiment is shown in FIGS. 5–7, where it will be understood that the portions of the dishwasher not shown are generally identical with the embodiment of FIGS. 1–4. The dishwasher includes a pump 121 driven by a motor 122, and the pump 121 is substantially the same as the pump 21 shown in the previous embodiment, except that it has no outlet for a secondary wash circulation. Thus, the pump has a main outlet 127 directing the flow to a main spray arm 128 and a drain outlet 131. The pump 121 includes an internal diverter valve which operates in such a manner that during the wash or recirculate mode, all of the output of the pump goes to the main spray arm 128, and the drain outlet 131 is blocked off by the diverter valve. During the drain portion of the cycle, the diverter valve moves to block off the main outlet 127, and all of the outlet of the pump is then directed to the drain outlet 131.

The drain outlet 131 is connected through a drain hose 133 to a filter unit 136, where it is connected to a drain inlet 137. Filter 136 also has a drain outlet 141 to be connected to the exterior drain and a third level outlet 146 through which fluid can pass through a tube 147 to a third level spray arm.

The filter unit 136 is shown in greater detail in FIGS. 6 and 7, and is essentially the same as the filter shown in the embodiment of FIGS. 1–4. The unit does not include any rocker valve or other moving parts and the secondary inlet is closed off. Filter 136 is composed of a thermoplastic material formed into a left half 151 and a right half 152 joined together along a peripheral flange 153 by suitable means such as heat sealing or ultrasonic welding. A groove 154 is formed in two members 151 and 152, and receives a screen 155 surrounded by and secured to a frame 156 adapted to make sealing engagement with the groove 154 when the unit is assembled. The screen 155 divides the filter unit then into an upper chamber 158 and a lower chamber 159. The drain inlets and outlets 137 and 141 are connected to the bottom chamber 159, while the upper chamber 158 is connected to the third level outlet 146. In order to allow use of the same tooling, the other inlet 138 can be closed off by a plug 160 when the member 152 is molded.

When the dishwasher is operated and is in the wash or recirculate mode, no fluid flows from the drain outlet 131 and, therefore, there is no flow through the filter unit 136. Therefore, under wash conditions, there is no flow of filtered water through the third level spray arm onto the dishes.

However, when the pump goes into the drain mode, all of the water from the pump outlet goes through the drain outlet 131, through hose 133, and into the filter unit lower chamber 159. The fluid to be drained is then free to pass through the drain outlet 141 to the exterior household drain. However, because there is a certain amount of back pressure through the drain, there will be a flow of fluid upward through the screen 155 into the upper chamber 158. As the drain fluid passes through the filter 155, all of the soil particles are filtered out and the filtered fluid then goes to the third level wash arm, where it is sprayed down upon the dishes as long as there is fluid in the dishwasher being pumped to drain at a sufficient rate and at a sufficient pressure to cause flow to the third level wash arm. Thus, while the third level wash arm is not effective during wash, it does deliver a filtered soil-free flow during the drain portions of each cycle to wash any redeposited soil particles off the dishes and back to the sump, and hence to drain.

Because the drain inlet 137 is directly below the screen 155, the high velocity of the incoming drain water flowing across the lower surface of the screen clears soil particles from the underside of the screen and washes them out through the drain outlet 141. Thus, no soil buildup occurs in the filter, which is therefore self-cleaning.

While several embodiments of this invention have been shown and described in detail, it is recognized that various modifications and rearrangements may be resorted to without departing from the scope of the invention as defined in the claims.

What is claimed is:

1. A dishwasher having a tub defining a washing chamber having a bottom and a top, a sump at the bottom of said washing chamber, a first spray arm at the bottom of said washing chamber above said sump, a second spray arm at the top of said washing chamber, a pump mounted below said sump and having an inlet connected to said sump, said pump having a first outlet connected to said first spray arm, a filter housing having an interior and having an inlet and first and second outlets, a filter screen in said filter housing, said filter screen dividing the interior of said filter housing into first and second filter chambers, said first filter outlet being connected to said first filter chamber, conduit means connecting said first filter outlet to said second spray arm, said filter inlet and said second filter outlet being connected to said second filter chamber, said pump having a second outlet connected to said filter inlet, said second filter outlet being connected to an external drain, said second filter chamber having a second filter inlet and said pump having a third outlet in parallel with said first pump outlet and connected to said second filter inlet so that said fluid can flow to said second spray arm through said filter screen from both said second and said third pump outlets.

2. A dishwasher as set forth in claim 1, including valve means in said second filter chamber operable to close said second filter outlet when fluid flows into said second filter chamber from said third pump outlet.

3. A dishwasher as set forth in claim 2, wherein said valve means is operated by fluid flow from said third pump outlet.

4. A dishwasher as set forth in claim 2, wherein said valve means is operable to open said second filter outlet when fluid flows into said second filter chamber from said second pump outlet.

5. A dishwasher as set forth in claim 4, wherein said valve means also closes said second filter chamber inlet.

6. A dishwasher having a tub defining a washer chamber having a bottom and a top, a sump at the bottom of said washing chamber, a first spray arm at the bottom of said washing chamber above said sump, a second spray arm at the top of said washing chamber, a pump mounted below said sump and having an inlet connected to said sump, said pump having a first outlet connected to said first spray arm, a filter housing having an interior, a filter screen in said filter housing, said filter screen dividing the interior of said filter housing into first and second filter chambers, said filter housing having an inlet side and an outlet side, said filter housing having first and second outlets on said outlet side and first and second inlets on said inlet side, said first filter outlet being connected to said first filter chamber, conduit means connecting said first filter outlet to said second spray arm, said first and second inlets and said second outlet being connected to said second filter chamber, said pump having a second outlet connected to said first filter inlet, said pump having a third outlet connected to said second filter inlet, said second filter outlet being connected to an external drain, whereby said second spray arm is supplied with fluid passing through said filter screen when fluid flows through either said second or third pump outlets to said filter.

7. A dishwasher as set forth in claim 6, including valve means in said second filter chamber operable to close said second filter outlet when fluid flows into said second filter chamber from said third pump outlet.

8. A dishwasher as set forth in claim 7, wherein said second filter outlet and said second filter inlet are in axial alignment.

9. A dishwasher as set forth in claim 8, wherein said valve means is pivotally mounted in said second filter chamber and movable between first and second positions to selectively seal said second filter outlet and said second filter inlet.

10. A dishwasher as set forth in claim 9, including deflector means carried by said valve means and extending adjacent said first filter inlet, whereby fluid flowing into said second filter chamber through said first filter inlet moves said valve means to seal said second filter inlet.

11. A dishwasher as set forth in claim 10, wherein said deflector is constructed and arranged to cause fluid from said first filter inlet to flow against said filter screen to wash soil particles off said screen and cause them to flow to the external drain through said second filter outlet.

* * * * *